US010639816B2

(12) United States Patent
Jibiki et al.

(10) Patent No.: US 10,639,816 B2
(45) Date of Patent: May 5, 2020

(54) RARE EARTH SINTERED MAGNET FASTENING JIG

(71) Applicant: Shin-Etsu Chemical Co., Ltd., Tokyo (JP)

(72) Inventors: Takafumi Jibiki, Echizen (JP); Kazuhito Akada, Echizen (JP); Takafumi Ueno, Echizen (JP); Kennosuke Izumi, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 192 days.

(21) Appl. No.: 15/854,401

(22) Filed: Dec. 26, 2017

(65) Prior Publication Data

US 2018/0178410 A1 Jun. 28, 2018

(30) Foreign Application Priority Data

Dec. 28, 2016 (JP) ..... 2016-255022

(51) Int. Cl.
*B28D 7/04* (2006.01)
*B28D 1/24* (2006.01)
(Continued)

(52) U.S. Cl.
CPC ..... *B28D 7/04* (2013.01); *B24B 27/06* (2013.01); *B24B 41/06* (2013.01); *B28D 1/24* (2013.01);
(Continued)

(58) Field of Classification Search
CPC ... B23Q 3/00; B23Q 3/02; B23Q 3/06; B23Q 3/062; B23Q 3/066; B25B 1/00;
(Continued)

(56) References Cited

U.S. PATENT DOCUMENTS 3,416,784 A * 12/1968 Wermuth ..... B25B 1/24 269/136
3,561,748 A * 2/1971 Schefers ..... B23Q 3/00 269/8
(Continued)

FOREIGN PATENT DOCUMENTS

JP 2001-212730 A 8/2001
JP 2010-110850 A 5/2010
(Continued)

OTHER PUBLICATIONS

Search Report and Written Opinion dated May 16, 2018, issued in counterpart Philippine Application No. 1/2018/000003. (6 pages).
(Continued)

*Primary Examiner* — Tyrone V Hall, Jr.
(74) *Attorney, Agent, or Firm* — Westerman, Hattori, Daniels & Adrian, LLP

(57) ABSTRACT

A fastening jig for securing a magnet block (M) when the magnet block is cutoff machined into pieces is provided, the jig comprising a lower clamp (31) on which the magnet block is rested, an upper clamp (32) disposed on the magnet block, and a press unit (33) for pressing the clamps to apply a pressing force to the magnet block. A portion of the lower clamp (31) which is disposed adjacent to the magnet block is provided with a generally horizontal channel (311) to define a resilient cantilever (312), whereby the magnet block is held between the clamps by the repulsion force of the cantilever (312).

4 Claims, 5 Drawing Sheets

(51) Int. Cl.

| | |
|---|---|
| ***H01F 41/02*** | (2006.01) |
| ***H01F 1/057*** | (2006.01) |
| ***B24B 41/06*** | (2012.01) |
| ***B24B 27/06*** | (2006.01) |

(52) U.S. Cl.
CPC ..... *H01F 1/0577* (2013.01); *H01F 41/0253* (2013.01)

(58) Field of Classification Search
CPC .... B25B 1/20; B25B 1/04; B25B 1/22; B25B 1/24; B25B 1/2405; B25B 1/241; B25B 5/00; B25B 5/04; B25B 5/14; B25B 5/16; B25B 5/163; B25B 11/00; B25B 11/02; Y10T 29/49046; B28D 7/04; B28D 1/24
See application file for complete search history.

(56) References Cited

U.S. PATENT DOCUMENTS

| | | | | |
|---|---|---|---|---|
| 3,951,395 | A * | 4/1976 | Hennenfent | B25B 1/2405 269/266 |
| 4,411,415 | A * | 10/1983 | Denaro | B25B 1/2473 269/134 |
| 4,925,168 | A * | 5/1990 | Ramsbro | B25B 1/2473 269/136 |
| 5,730,434 | A | 3/1998 | Schoene et al. | |
| 8,568,203 | B2 * | 10/2013 | Sato | B24B 27/0658 451/53 |
| 8,702,083 | B2 * | 4/2014 | Doi | B28D 1/24 269/289 R |
| 8,702,084 | B2 * | 4/2014 | Doi | B28D 1/24 269/289 R |
| 2011/0312255 | A1 | 12/2011 | Akada et al. | |

FOREIGN PATENT DOCUMENTS

| | | | |
|---|---|---|---|
| JP | 2010-110851 | A | 5/2010 |
| JP | 2010-110966 | A | 5/2010 |
| JP | 2011-156655 | A | 8/2011 |
| JP | 2011-156863 | A | 8/2011 |
| JP | 2012-708 | A | 1/2012 |
| JP | 2014-83668 | A | 5/2014 |

OTHER PUBLICATIONS

Office Action dated Oct. 29, 2019, issued in counterpart JP Application No. 2016-255022, with English translation (5 pages).

* cited by examiner

RARE EARTH SINTERED MAGNET FASTENING JIG

CROSS-REFERENCE TO RELATED APPLICATION

This non-provisional application claims priority under 35 U.S.C. § 119(a) on Patent Application No. 2016-255022 filed in Japan on Dec. 28, 2016, the entire contents of which are hereby incorporated by reference.

TECHNICAL FIELD

This invention relates to a fastening jig for securing a rare earth sintered magnet block when the rare earth sintered magnet block, typically Nd—Fe—B sintered magnet block is cutoff machined into multiple pieces.

BACKGROUND ART

Systems for manufacturing commercial products of sintered magnet include a single part system wherein a part of substantially the same shape as the product is produced at the stage of press forming, and a multiple part system wherein once a large block is formed, it is divided into a multiplicity of parts by machining. When it is desired to manufacture parts of small size or parts having a reduced thickness in magnetization direction, the sequence of press forming and sintering is difficult to form sintered parts of normal shape. Thus the multiple part system is the mainstream of sintered magnet manufacture.

As the tool for cutting rare earth sintered magnet blocks, a grinding wheel outer-diameter (OD) blade having diamond abrasive grains bonded to the outer periphery of a thin disk as a core is mainly used from the aspect of productivity. In the case of OD blades, multiple cutting is possible. A multiple blade assembly comprising a plurality of cutoff abrasive blades coaxially mounted on a rotating shaft alternately with spacers, for example, is capable of multiple cutoff machining, that is, to machine a block into a multiplicity of parts at a time.

The current desire for more efficient manufacture of rare earth sintered magnet entails a propensity to enlarge the size of magnet blocks to be cutoff machined, indicating an increased depth of cut. When a magnet block has an increased height, the effective diameter of the cutoff abrasive blade, that is, the distance from the rotating shaft or spacer to the outer periphery of the blade (corresponding to the maximum height of the cutoff abrasive blade available for cutting) must be increased. Such larger diameter cutoff abrasive blades are more liable to deformation, especially to deflect on axial direction. As a result, a rare earth magnet block is cut into pieces of degraded shape and dimensional accuracy. The prior art uses thicker cutoff abrasive blades to avoid the deformation. Thicker cutoff abrasive blades, however, are inconvenient in that more material is removed by cutting. Then the number of magnet pieces cut out of a magnet block of the same size is reduced as compared with thin cutoff abrasive blades. Under the economy where the price of rare earth metals increases, a reduction in the number of magnet pieces is reflected by the manufacture cost of rare earth magnet products.

While there is a desire for the method for cutoff machining a magnet block having an increased depth of cut without increasing the effective diameter of cutoff abrasive blades, a method involving sawing an upper half of a magnet block, turning the block upside down, and sawing a lower half (upper half after the upside-down turning) of the magnet block is known. This method is successful in reducing the effective diameter of cutoff abrasive blades to about one half, as compared with the method of sawing a magnet block in one direction, and thus overcomes the above-discussed problems of dimensional accuracy and the width to be sawn associated with thick blades, but needs strict alignment of the cutting position before and after the upside-down turning. The step of alignment of the cutting position takes a time. If the cutting position is misaligned even slightly, a step is formed between upper and lower cutoff surfaces. If so, the step must be eliminated or smoothened by surface grinding after the cutoff machining. When cutoff machining is continuously performed as is often the case in commercial manufacture, it is impossible in a substantial sense to cutoff machine all magnet blocks without leaving a step between upper and lower cutoff surfaces. Thus a magnet block is typically sawn into slightly thicker pieces, with an allowance for surface grinding being taken into account. The number of magnet pieces cut out of a magnet block of the same size is reduced in this case too.

CITATION LIST

Patent Document 1: JP-A 2010-110850
Patent Document 2: JP-A 2010-110851
Patent Document 3: JP-A 2010-110966
Patent Document 4: JP-A 2011-156655
Patent Document 5: JP-A 2011-156863
Patent Document 6: JP-A 2012-000708 (US 2011/0312255 A1)

DISCLOSURE OF INVENTION

An object of the invention is to provide a magnet block fastening jig for use in a method for cutoff machining a rare earth sintered magnet block having a substantial height into a multiplicity of pieces at a high accuracy, by using a plurality of thin cutoff abrasive blades having a reduced effective diameter, while controlling formation of a step between cutoff surfaces.

The invention is directed to a method for multiple cutoff machining a rare earth sintered magnet block using a multiple blade assembly comprising a plurality of cutoff abrasive blades coaxially mounted on a rotating shaft at axially spaced apart positions, each blade comprising a core in the form of a thin disk and a peripheral cutting part on the outer periphery of the core. The cutoff abrasive blades are rotated and fed to cutoff machine the magnet block into a multiplicity of pieces. The inventors have found that the object is achievable by setting the multiple blade assembly such that it is movable parallel to the plane of rotation of the blades, rotating and feeding the blades, starting the machining operation of the magnet block on one side to form cutting grooves in the magnet block, interrupting the machining operation before the magnet block is cut into pieces, moving the multiple blade assembly to the other side of the magnet block parallel to the plane of rotation of the blades, with the magnet block kept fixed, restarting the machining operation of the magnet block on the other side to form cutting grooves in the magnet block until the cutting grooves formed from the one side and the other side merge with each other, thereby cutting the magnet block into pieces. Then a rare earth sintered magnet block having a substantial height can be cutoff machined or sawn into a multiplicity of pieces at a high accuracy and productivity, by using the multiple blade assembly comprising a plurality of thin cutoff abrasive blades having a reduced effective diameter, and feeding the multiple blade assembly parallel to the plane of rotation of the blades, without a need for alignment of the magnet block, while controlling formation of a step between cutoff surfaces.

In the multiple cutoff machining of a rare earth sintered magnet block, the one side and the other side of the magnet block are preferably opposite sides in a horizontal direction. More preferably, the magnet block at its upper and lower surfaces is clamped by a fastening jig. Further preferably, the fastening jig includes a first clamp on which the magnet block is rested, a second clamp disposed on the magnet block, and a press unit for pressing the first and second clamps to apply a pressing force to the magnet block from one or both of its upper and lower sides. A portion of one clamp (or both clamps) which is disposed adjacent to the magnet block is provided with a generally horizontal channel extending inward from a position corresponding to a work surface of the magnet block, to define a resilient cantilever, whereby the magnet block is held between the first and second clamps by the repulsion force created by vertical movement of the resilient cantilever. Although the magnet block is susceptible to cracking or chipping upon application of a noticeable force because of its construction, the jig ensures that the magnet block is vertically held within the fastening jig in a tight, flexible manner. This further contributes effectively to high-accuracy machining when the magnet block is machined on the one side or the other side in horizontal direction.

In connection with a method for multiple cutoff machining a rare earth sintered magnet block by using a multiple blade assembly comprising a plurality of cutoff abrasive blades coaxially mounted on a rotating shaft at axially spaced apart positions, rotating and feeding the cutoff abrasive blades to cutoff machine the magnet block into a multiplicity of pieces, the present invention provides a fastening jig for securing the magnet block comprising a first clamp on which the magnet block is rested, a second clamp disposed on the magnet block, and a press unit for pressing the first and second clamps to apply a pressing force to the magnet block from one or both of its upper and lower surfaces. A portion of at least one clamp which is disposed adjacent to the magnet block is provided with a generally horizontal channel extending inward from a position corresponding to a work surface of the magnet block, to define a resilient cantilever, whereby the magnet block is held between the first and second clamps by the repulsion force created by vertical movement of the resilient cantilever.

In a preferred embodiment, the portion of at least one clamp which is disposed adjacent to the magnet block is partially raised to form pads near positions corresponding to opposite work surfaces of the magnet block so that the clamp contacts only at its pads with the opposing surface of the magnet block.

In a preferred embodiment, the portion of at least one clamp which is disposed adjacent to the magnet block is provided with rims at positions corresponding to opposite work surfaces of the magnet block, the rims being engaged with the magnet block for preventing the magnet block from separating apart.

In a further preferred embodiment, only the first clamp is provided with the resilient cantilever, and the surface of the second clamp which is disposed adjacent to the magnet block is flat so that the second clamp is in plane contact with the entire opposing surface of the magnet block.

Advantageous Effect of Invention

Using a plurality of thin cutoff abrasive blades having a reduced effective diameter, a rare earth sintered magnet block having a substantial height can be sawn into a multiplicity of pieces at a high accuracy. The invention is also effective for controlling formation of a step on cutoff surface.

DESCRIPTION OF EMBODIMENTS

Figure 1:
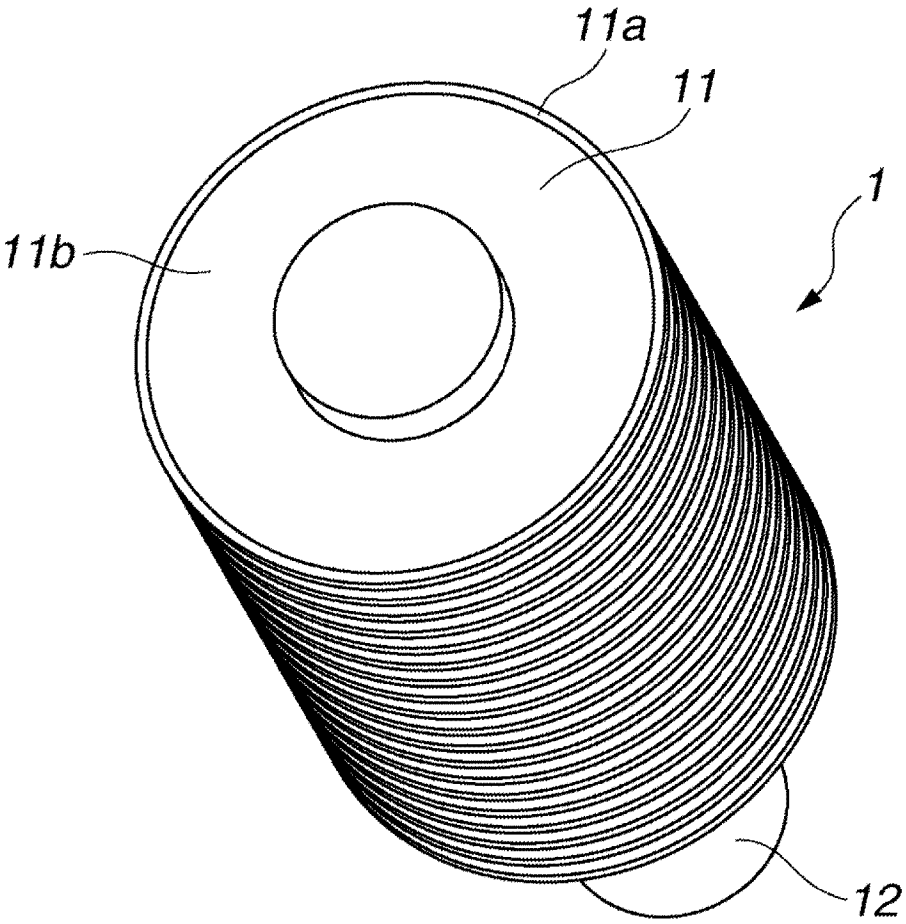
FIG. 1 is a perspective view illustrating one exemplary multiple blade assembly used in the invention.

In the following description, like reference characters designate like or corresponding parts throughout the several views shown in the figures. It is understood that terms such as "upper", "lower", "outward", "inward", "vertical", and the like are words of convenience, and are not to be construed as limiting terms. Herein, a magnet block of generally rectangular shape has opposite surfaces on one and other sides in a horizontal direction, and upper and lower ends in a vertical direction. The term "work surface" refers to the surface of a magnet block to be cutoff machined.

The method for multiple cutoff machining a rare earth sintered magnet block according to the invention uses a multiple blade assembly comprising a plurality of cutoff abrasive blades coaxially mounted on a rotating shaft at axially spaced apart positions, each blade comprising a core in the form of a thin disk and a peripheral cutting part on the outer periphery of the core. The multiple blade assembly is placed relative to the magnet block. The cutoff abrasive blades are rotated and fed to cutoff machine the magnet block into a multiplicity of magnet pieces. During machining operation, cutting grooves are formed in the magnet block.

Any prior art well-known multiple blade assembly may be used in the multiple cutoff machining method. As shown in FIG. 1, one exemplary multiple blade assembly 1 includes a rotating shaft 12 and a plurality of cutoff abrasive blades or OD blades 11 coaxially mounted on the shaft 12 alternately with spacers (depicted at 13 in FIG. 2), i.e., at axially spaced apart positions. Each blade 11 includes a core 11*b* in the form of a thin disk or thin doughnut disk and a peripheral cutting part or abrasive grain-bonded section 11*a* on the outer periphery of the core 11*b*. Note that the number of cutoff abrasive blades 11 is not particularly limited, although the number of blades generally ranges from 2 to 100, with 19 blades illustrated in the example of FIG. 1.

The dimensions of the core are not particularly limited. Preferably the core has an outer diameter of 80 to 250 mm, more preferably 100 to 200 mm, and a thickness of 0.1 to 1.4 mm, more preferably 0.2 to 1.0 mm. The core in the form of a thin doughnut disk has a bore having a diameter of preferably 30 to 100 mm, more preferably 40 to 90 mm. Understandably, the rotating shaft extends through the bores of the blades in the blade assembly.

The core of the cutoff abrasive blade may be made of any desired materials commonly used in cutoff blades including tool steels SK, SKS, SKD, SKT and SKH, although cores of cemented carbide are preferred because the cutting part or blade tip can be thinner. Suitable cemented carbides of which cores are made include alloy forms of powdered carbides of metals in Groups IVA (4), VA (5) and VIA (6) in the Periodic Table, such as WC, TiC, MoC, NbC, TaC, and $Cr_3C_2$, which are cemented with Fe, Co, Ni, Mo, Cu, Pb, Sn or alloys thereof. Of these, WC—Co, WC—Ni, TiC—Co, and WC—TiC—TaC—Co systems are typical and preferred for use herein.

The peripheral cutting part or abrasive grain-bonded section is formed to cover the outer periphery of the core and comprises abrasive grains and a binder. Typically diamond grains, cBN grains or mixed grains of diamond and cBN are bonded to the outer periphery of the core using a binder. Three bonding systems including resin bonding with resin binders, metal bonding with metal binders, and electroplating are typical and any of them may be used herein.

The peripheral cutting part or abrasive grain-bonded section has a width W in the thickness or axial direction of the core, which is from (T+0.01) mm to (T+4) mm, more preferably (T+0.02) mm to (T+1) mm, provided that the core has a thickness T. An outer portion of the peripheral cutting part or abrasive grain-bonded section that projects radially outward from the outer periphery of the core has a projection distance which is preferably 0.1 to 8 mm, more preferably 0.3 to 5 mm, depending on the size of abrasive grains to be bonded. The distance of the peripheral cutting part in radial direction of the core (i.e., radial distance of the overall peripheral cutting part) is preferably 0.1 to 10 mm, more preferably 0.3 to 8 mm. The spacing between cutoff abrasive blades may be suitably selected depending on the thickness of magnet pieces after cutting, and preferably set to a distance which is slightly greater than the thickness of magnet pieces, for example, by 0.01 to 0.4 mm. For machining operation, the cutoff abrasive blades are preferably rotated at 1,000 to 15,000 rpm, more preferably 3,000 to 10,000 rpm.

A rare earth sintered magnet block is held as presenting one and other sides in a horizontal direction and upper and lower surfaces in a vertical direction. The multiple blade assembly is set such that it is movable parallel to the plane of rotation of the blades. The magnet block is machined or sawn into a multiplicity of pieces by rotating and feeding the cutoff abrasive blades. According to the invention, the magnet block is cutoff machined by starting the machining operation of the magnet block on one side to form cutting grooves in the magnet block, interrupting the machining operation before the magnet block is cut into pieces, moving the multiple blade assembly to the other side of the magnet block parallel to the plane of rotation of the blades, with the magnet block kept in place, and restarting the machining operation of the magnet block on the other side to form cutting grooves in the magnet block until the cutting grooves formed from the one side and the other side merge with each other, thereby cutting the magnet block into pieces. Differently stated, the magnet block is machined from the front surface and the back surface in sequence.

Figure 2F:
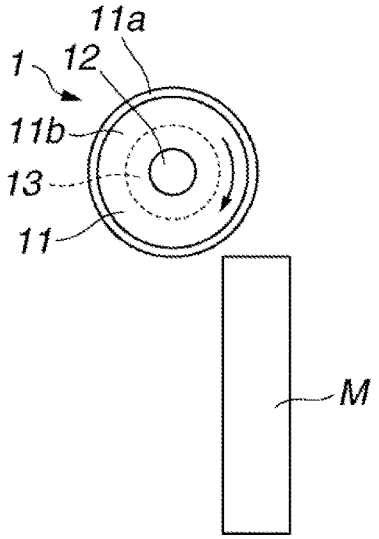
FIGS. 2A to 2F are elevational views schematically illustrating one exemplary multiple cutoff machining method according to the invention, FIG. 2A showing the multiple blade assembly placed on one side of the magnet block, FIG. 2B showing the step of machining the magnet block on the one side, FIG. 2C showing the completion of machining of the magnet block on the one side, FIG. 2D showing the multiple blade assembly moved to the other side of the magnet block, FIG. 2E showing the step of machining the magnet block on the other side, and FIG. 2F showing the completion of machining of the magnet block on the other side.
Figure 2C:
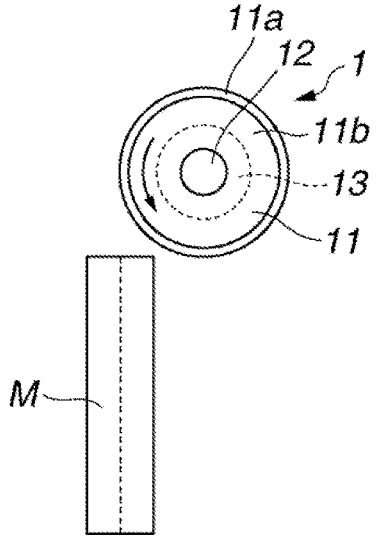
Figure 2E:
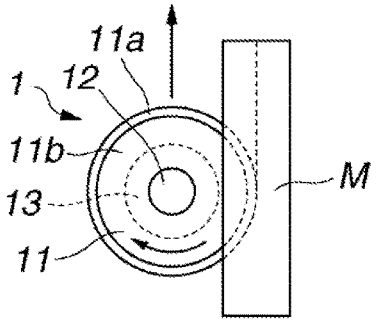
Figure 2B:
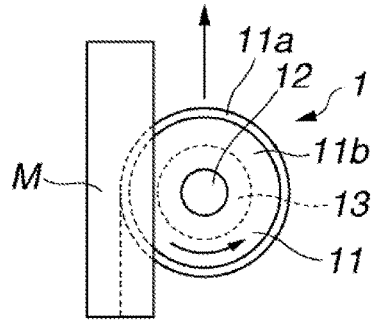
Figure 2D:
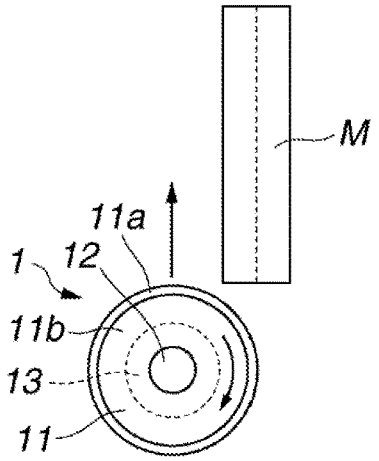
Figure 2A:
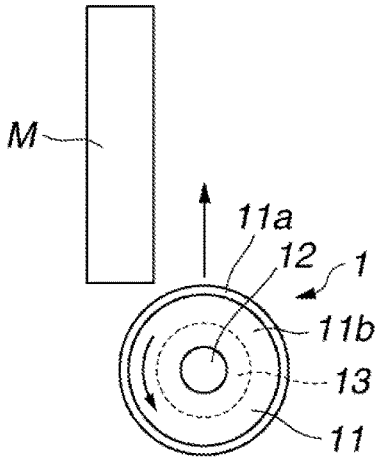

By referring to FIGS. 2A to 2F, the machining operation is described in more detail. As shown in FIG. 2A, the multiple blade assembly 1 is set on one side of the magnet block M (right side in FIG. 2A), with the plane of rotation of cutoff abrasive blades 11 extending vertically. As shown in FIG. 2B, the machining operation is started by feeding the rotating blade assembly 1 from the lower end to the upper end of the magnet block M, with the blades facing from one side toward the other side of the magnet block M. At the time when cutting grooves are formed in the magnet block M to a depth (depicted by the thin line) corresponding to about one half of the thickness of the magnet block M as shown in FIG. 2C, the machining operation is interrupted. Then, as shown in FIG. 2D, the blade assembly 1 is moved to the other side of the magnet block M parallel to the plane of rotation of blades 11, with the magnet block M kept fixed. The machining operation is restarted by feeding the rotating blade assembly 1 from the lower end to the upper end of the magnet block M as shown in FIG. 2E, with the blades facing from the other side toward the one side of the magnet block M, to form cutting grooves in the remaining half portion of the magnet block M. Eventually, the cutting grooves formed from the one and other sides merge with each other as shown in FIG. 2F, that is, the magnet block is sawn throughout its thickness, whereby the magnet block M is divided into pieces. It is noted in FIG. 2 that spacers 13 are disposed on the rotating shaft 12 between the blades 11 while the remaining construction is the same as in FIG. 1.

According to the invention, a workpiece (or rare earth sintered magnet block) to be replaced on every cutoff machining step is secured stationary during the machining operation. On the other hand, the cutting tool (or multiple blade assembly) is easy to repeat the same operation at the same position. Thus, the multiple blade assembly is moved parallel to the plane of rotation of cutoff abrasive blades, specifically the multiple blade assembly is moved from the one side to the other side of the magnet block such that the plane of rotation of cutoff abrasive blades remains on the same imaginary plane before and after the movement. Then machining operation can be repeated without causing any misalignment between the cutting grooves formed from the one and other sides. Thus using a plurality of thin cutoff abrasive blades having a reduced effective diameter, a rare earth sintered magnet block having a substantial height can be sawn into a multiplicity of pieces at a high accuracy while minimizing a step on the cutoff surface at the merger point between cutting grooves.

The inventive method deals with a rare earth sintered magnet block having a height of at least 5 mm, typically 10 to 100 mm and uses cutoff abrasive blades having a core thickness of up to 1.2 mm, more preferably 0.2 to 0.9 mm and an effective diameter of up to 200 mm, more preferably 10 to 180 mm. Notably, the effective diameter is the distance from the rotating shaft or spacer to the outer edge of the blade and corresponds to the maximum height of a magnet block that can be cut by the blade. Then the magnet block can be cutoff machined at a high accuracy and high efficiency as compared with the prior art.

In the practice of the invention, it is possible that the one side and the other side of the magnet block be one and other sides in a vertical direction, that is, the work surfaces of the magnet block be set as upper and lower surfaces in a vertical direction, and the magnet block be machined on the upper side and then on the lower side. However, it is recommended that the one side and the other side of the magnet block be set as one and other sides in a horizontal direction as shown in FIGS. 2A to 2F, because it is easy to secure the magnet block in this posture, and the influence of gravity on the magnet block, blades and coolant (cutting fluid) to be described later may be equalized on the one and other sides. That is, the work surfaces of the magnet block are disposed in a right/left direction (or front/back direction) and the magnet block is machined on the right and left sides (on the front and back sides).

In each of the machining operations on the one and other sides, it is possible to machine the magnet block while the cutoff abrasive blades are fed perpendicular to the work surface of the magnet block, for example, in the arrangement of the multiple blade assembly 1 and the magnet block M shown in FIGS. 2A to 2F, to machine the magnet block while the blades 11 are horizontally fed. However, since it is preferable that the magnet block be supported at opposite ends of its work surfaces (in the arrangement of the multiple blade assembly 1 and the magnet block M shown in FIGS. 2A to 2F, the magnet block be supported at upper and lower ends), it is recommended to machine the magnet block while the blades 11 are fed parallel to the work surface of the magnet block, that is, to machine the magnet block M while the blades 11 are vertically fed as shown in FIGS. 2A to 2F.

A rare earth sintered magnet block is cutoff machined into a multiplicity of pieces by rotating cutoff abrasive blades (i.e., OD blades), feeding a cutting fluid, and moving the blades relative to the magnet block with the abrasive portion of the blade kept in contact 1*s* with the magnet block (specifically moving the blades in the transverse and/or thickness direction of the magnet block). Then the magnet block is cut or machined by the cutoff abrasive blades. It is noted that the cutting fluid used herein is also known as a coolant and is a liquid, typically water, which may contain liquid or solid additives.

In the multiple cutoff machining of a magnet block, the magnet block is fixedly secured by any suitable means. In one method, the magnet block is bonded to a support plate (e.g., of carbon base material) with wax or a similar adhesive which can be removed after machining operation, whereby the magnet block is fixedly secured prior to machining operation. In another method, the magnet block is fixedly secured by a fastening jig.

In the machining of a magnet block, first on the one side of the magnet block, either one or both of the multiple blade assembly and the magnet block are relatively moved in the cutting or transverse direction of the magnet block from one end to the other end of the magnet block (parallel to the work surface of the magnet block), whereby the work surface of the magnet block is machined to a predetermined depth throughout the transverse direction to form cutting grooves in the magnet block.

The cutting grooves may be formed by a single machining operation or by repeating plural times machining operation in a direction perpendicular to the work surface of the magnet block. The depth of the cutting grooves is preferably 40 to 70/o, most preferably about 50% of the height of the magnet block to be cut although the depth varies somewhat on every machining operation, depending on the degree of wear of cutoff abrasive blades. The width of the cutting grooves is determined by the width of cutoff abrasive blades. Usually, the width of the cutting grooves is slightly greater than the width of the cutoff abrasive blades due to the vibration of the cutoff abrasive blades during machining operation, and specifically in a range equal to the width of the cutoff abrasive blades (or peripheral cutting parts) plus 1 mm at most, more preferably plus 0.5 mm at most, and even more preferably plus 0.1 mm at most.

The machining operation is interrupted before the magnet block is divided into discrete pieces. The multiple blade assembly is moved from the one side to the other side of the magnet block. The machining operation is restarted on the other side of the magnet block. Like on the one side, either one or both of the multiple blade assembly and the magnet block are relatively moved in the cutting or transverse direction of the magnet block from one end to the other end of the magnet block (parallel to the work surface of the magnet block), whereby the work surface of the magnet block is machined to a predetermined depth throughout the transverse direction to form cutting grooves in the magnet block. Likewise, the cutting grooves may be formed by a single machining operation or by repeating plural times machining operation in the height direction of the magnet block. In this way, the portion of the magnet block left after the first groove cutting is cutoff machined.

During the machining operation, the cutoff abrasive blades are preferably rotated at a circumferential speed of at least 10 m/sec, more preferably 20 to 80 m/sec. Also, the cutoff abrasive blades are preferably fed at a feed or travel rate of at least 10 mm/min, more preferably 20 to 500 mm/min. Advantageously, the inventive method capable of high speed machining ensures a higher accuracy and higher efficiency during machining than the prior art methods.

During multiple cutoff machining of a rare earth sintered magnet block, a coolant or cutting fluid is generally fed to the cutoff abrasive blades to facilitate machining. To this end, a coolant feed nozzle is preferably used which has a coolant inlet at one end and a plurality of slits formed at another end and corresponding to the plurality of cutoff abrasive blades.

Figure 3A:
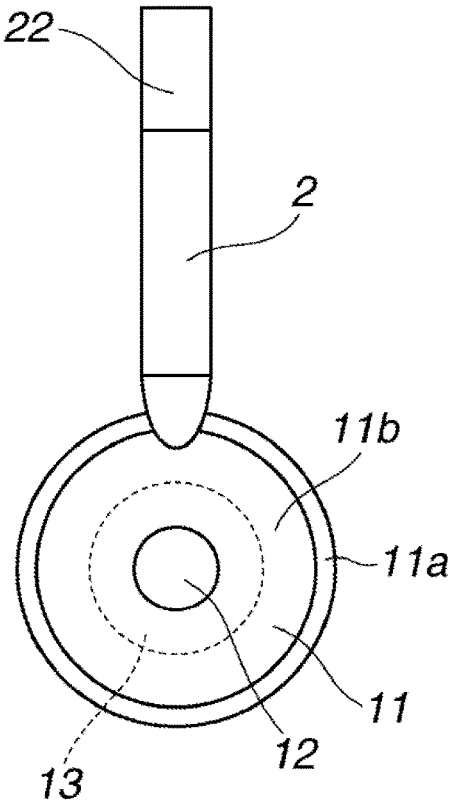
FIGS. 3A to 3C illustrate one exemplary multiple blade assembly combined with a coolant feed nozzle, FIG. 3A being an elevational front view, FIG. 3B being an elevational side view, and FIG. 3C being a bottom view of the nozzle showing slits.
Figure 3B:
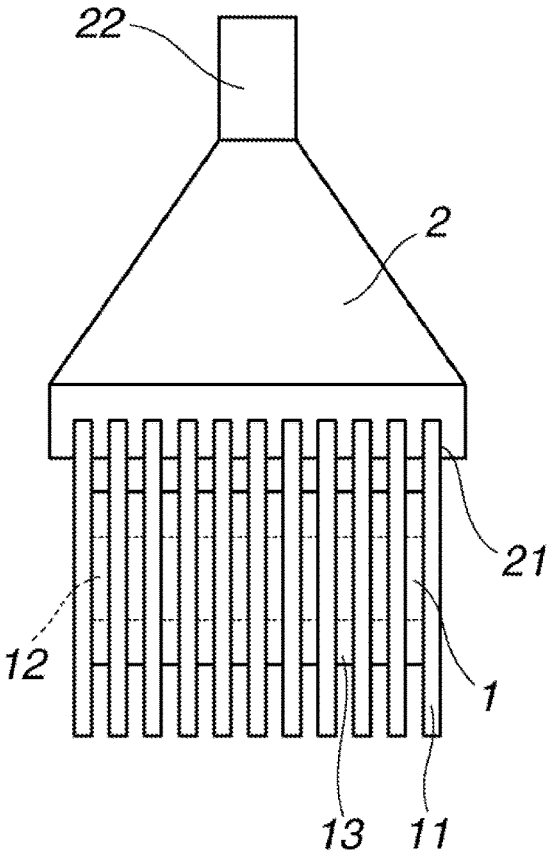
Figure 3C:
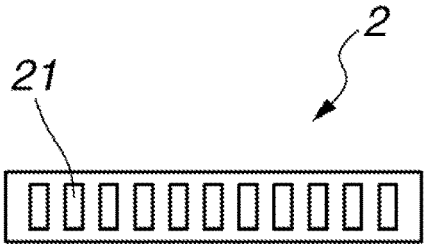

One exemplary coolant feed nozzle is illustrated in FIG. 3. This coolant feed nozzle 2 includes a hollow housing which has an opening at one end serving as a coolant inlet 22 and is provided at the other end with a plurality of slits 21. The number of slits corresponds to the number of cutoff abrasive blades and is typically equal to the number of cutoff abrasive blades 11 in the multiple blade assembly 1. The number of slits is not particularly limited although the number of slits generally ranges from 2 to 100, with eleven slits illustrated in the example of FIG. 3. The feed nozzle 2 is combined with the multiple blade assembly 1 such that an outer peripheral portion of each cutoff abrasive blade 11 may be inserted into the corresponding slit 21 in the feed nozzle 2. Then the slits 21 are arranged at a spacing which corresponds to the spacing between cutoff abrasive blades 11, and the slits 21 extend straight and parallel to each other. It is seen from FIG. 3 that spacers 13 are disposed on the rotating shaft 12 between the cutoff abrasive blades 11.

The outer peripheral portion of each cutoff abrasive blade which is inserted into the corresponding slit in the feed nozzle functions such that the coolant coming in contact with the cutoff abrasive blades is entrained on the surfaces (outer peripheral portions) of the cutoff abrasive blades and transported to points of cutoff machining on the magnet block. Then the slit has a width which must be greater than the width of the cutoff abrasive blade (i.e., the width W of the outer cutting part). Through slits having too large a width, the coolant may not be effectively fed to the cutoff abrasive blades and a more fraction of coolant may drain away from the slits. Provided that the peripheral cutting part of the cutoff abrasive blade has a width W (mm), the slit in the feed nozzle preferably has a width of from more than W mm to (W+6) mm, more preferably from (W+0.1) mm to (W+6) mm. The slit has such a length that when the outer peripheral portion of the cutoff abrasive blade is inserted into the slit, the outer peripheral portion may come in full contact with the coolant within the feed nozzle: Often, the slit length is preferably about 2% to 30% of the outer diameter of the core of the cutoff abrasive blade.

In the method for multiple cutoff machining a rare earth sintered magnet block, a fastening jig consisting of a pair of clamps is preferably used for clamping the magnet block in the vertical (or machining) direction for fixedly securing the magnet block. In one embodiment, the fastening jig includes a first clamp on which the magnet block is rested, a second clamp disposed on the magnet block, and a press unit for pressing the first and second clamps to apply a pressing force to the magnet block from one or both of its upper and lower surfaces. Further, a portion of at least one clamp which is disposed adjacent to the magnet block is provided with a generally horizontal channel extending inward from a position corresponding to one work surface of the magnet block, to define a resilient cantilever, whereby the magnet block is held between the first and second clamps by the repulsion force created by vertical movement of the resilient cantilever. The material of which the first and second clamps are made should be a material which has a balance of rigidity and resilience (deflection) and/or elasticity, and preferably is easily workable. Suitable materials include metal materials, typically steel materials such as chromium molybdenum steel, and aluminum alloys such as duralumin, and resin materials, typically engineering plastics such as polyacetal.

FIG. 4 shows one exemplary fastening jig. The fastening jig includes a first clamp 31 on which the magnet block M is rested, a second clamp 32 disposed on the magnet block M, and a press unit 33 for pressing the first and second clamps 31 and 32 to apply a pressing force to the magnet block M from one or both of its upper and lower surfaces. Further, a portion of the first clamp 31 which is disposed adjacent to the magnet block M is provided with generally horizontal channels 311, 311 each extending inward from a position corresponding to one work surface of the magnet block M, to define resilient cantilevers 312, 312 (above the channels 311, 311) in the first clamp 31 on its magnet block-adjoining side. The magnet block M is held between the first and second clamps 31 and 32 by the repulsion force created by downward movement of the resilient cantilevers 312, 312.

The press unit 33 includes a frame 331 enclosing the first clamp 31, the magnet block M, and the second clamp 32, and screws 332, 332 for pressing the second clamp 32 on the upper surface remote from the magnet block M. The screws 332, 332 are extended throughout the top beam of the frame 331 in thread engagement. As the screws 332, 332 are turned in the threaded holes in the frame 331, they press down the second clamp 32 for applying a pressing force to the magnet block M via the second clamp 32. The magnitude of pressing force may be controlled by the fastening torque of the screws or by using springs if necessary. Then the magnitude of pressing force may be adjusted in accordance with a particular machining load. If the magnitude of pressing force is too low, meaning that the pressing force is overwhelmed by the machining load, the workpiece can be shifted and the machining accuracy is worsened. If the magnitude of pressing force is too high, the workpiece can be moved at the final stage of cutoff machining, that is, when the magnet block is divided into pieces, causing chipping or flaws to the magnet pieces. Although the press unit 33 consists of the frame 331 and the screws 332 in the illustrated embodiment, the construction of the press unit is not limited thereto, for example, the press unit may be constructed by a frame, additional members, and a pneumatic or hydraulic cylinder, piston or the like.

The fastening jig of the above construction is effective particularly when the one side and the other side of the magnet block are opposite sides in horizontal direction during multiple cutoff machining, that is, the work surfaces of the magnet block are disposed in right-left direction (or front-back direction) and the magnet block is machined from the right side and the left side (or from the front side and the back side). The use of the fastening jig ensures that the magnet block is vertically secured in a tight, flexible manner.

Figure 4B:
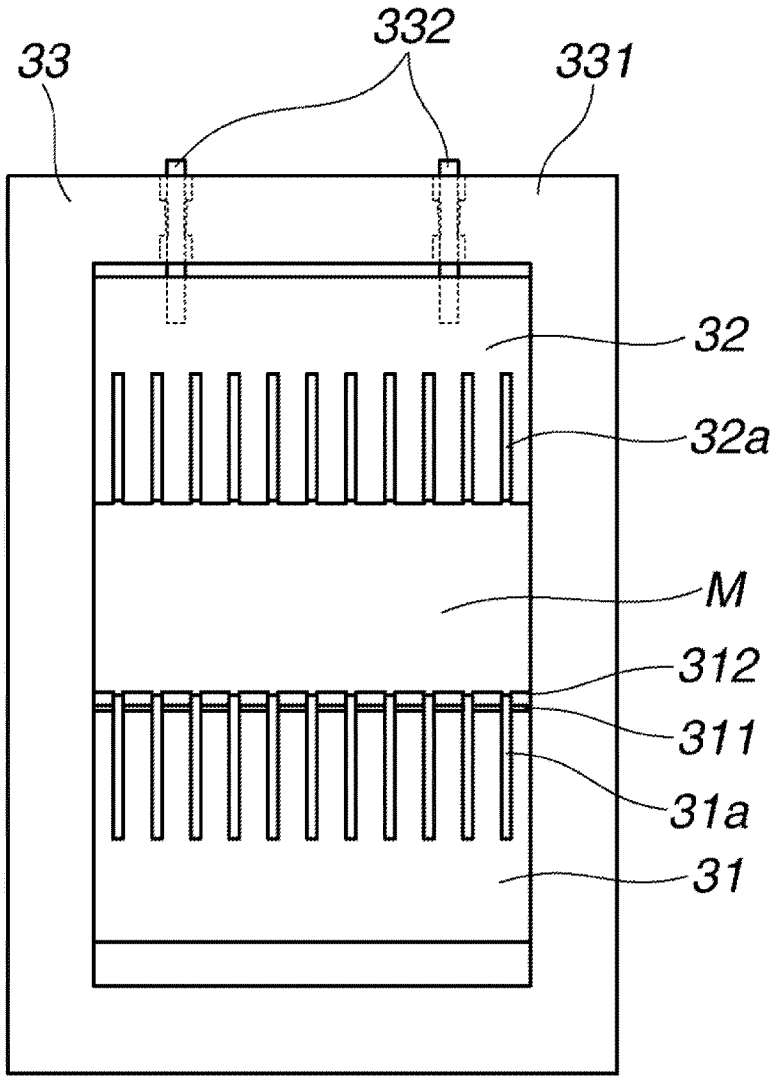
FIGS. 4A and 4B illustrate one exemplary fastening jig, FIG. 4A being a cross-sectional view, and FIG. 4B being an elevational front view.
Figure 4A:
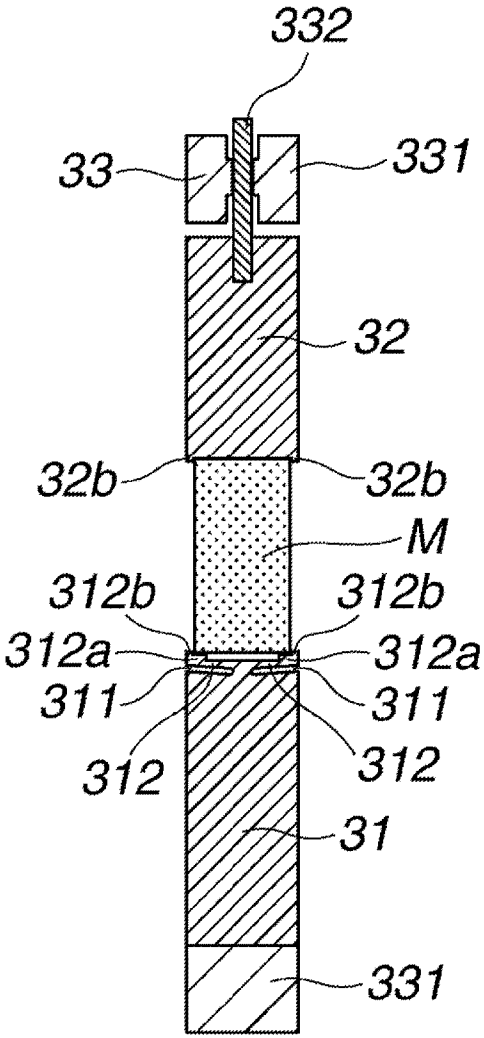

In a preferred embodiment of the fastening jig, the portion of the clamp on its magnet block-adjoining side where the resilient cantilevers are defined is partially raised at positions near the work surfaces of the magnet block to form pads so that the clamp contacts only at the pads with the opposing surface of the magnet block. Specifically, as shown in FIG. 4A, the first clamp 31 on its magnet block-adjoining side is partially raised at positions (left and right sides in FIG. 4A) corresponding to the work surfaces of the magnet block M, that is, distal portions of the first clamp 31 are raised relative to the remaining (formed thicker or higher than the remaining) to form pads 312*a*, 312*a*. Then the first clamp 31 contacts only at the pads 312*a*, 312*a* on the resilient cantilevers 312, 312 with the opposing surface of the magnet block M. The above-mentioned construction of the clamp including resilient cantilevers and pads ensures that as the resilient cantilevers 312, 312 are moved and spaced apart from the magnet block M (downward in FIG. 4A), they develop repulsion forces to the magnet block M to prevent the magnet block M from inclining.

In a preferred embodiment of the fastening jig, the portion of the clamp on its magnet block-adjoining side where the resilient cantilevers are defined is provided with rims at its ends corresponding to the work surfaces of the magnet block, the rims being engaged with the magnet block to prevent the magnet block from separating apart. Specifically, as shown in FIG. 4A, the portion of the first clamp 31 on its magnet block-adjoining side is further raised at its ends corresponding to the work surfaces of the magnet block, that is, end portions (left and right sides in FIG. 4A) of the first clamp 31 corresponding to the work surfaces of the magnet block M are raised relative to the remaining of the distal portions 312*a*, 312*a* (made thicker or higher than the remaining) to form rims. The raised rims or hooks 312*b*, 312*b* are in engagement with the magnet block M to prevent the magnet block M from disengaging from the first clamp 31 even when the resilient cantilevers 312, 312 are moved and spaced apart from the magnet block M (downward in FIG. 4A).

Figure 5:
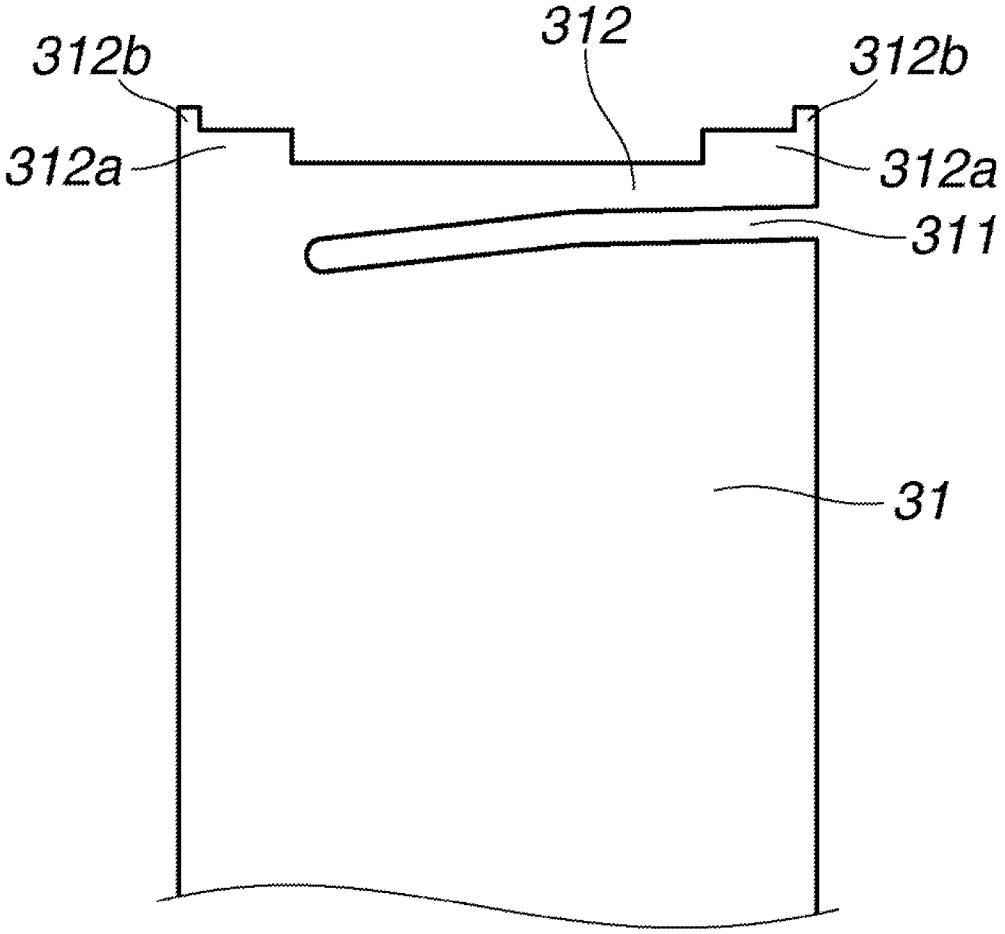
FIG. 5 is a partial elevational view showing another exemplary first clamp in the fastening jig.

In the illustrated embodiment, the portion of the first clamp which is disposed adjacent to the magnet block is provided with generally horizontal channels each extending inward from the position corresponding to the work surface of the magnet block to define resilient cantilevers above the channels, that is, two channels extend in opposite directions and two resilient cantilevers are formed. The invention is not limited to the illustrated embodiment. For example, in the case of the first clamp 31 shown in FIG. 5, a portion of the first clamp 31 which is disposed adjacent to the magnet block M is provided with a generally horizontal channel 311 extending inward from a position corresponding to one work surface of the magnet block M, to define a resilient cantilever 312 (above the channel 311). The magnet block M is held between the first and second clamps 31 and 32 by the repulsion force created by downward movement of the resilient cantilever 312. Similarly, the portion of the first clamp 31 which is disposed adjacent to the magnet block M is partially raised at the positions (left and right sides in FIG. 5) corresponding to the work surfaces of the magnet block M, that is, the distal portions of the first clamp 31 are raised relative to the remaining (made thicker or higher than the remaining) to form the pads 312*a*, 312*a*, and the further distal portions of the first clamp 31 are further raised to form the engagement rims 312*b*, 312*b*.

In a further embodiment, the fastening jig may be provided with a plurality of guide grooves corresponding to the cutoff abrasive blades of the multiple blade assembly so that the outer peripheral portion of each cutoff abrasive blade may be inserted into the corresponding guide groove. For example, as shown in FIG. 4B, the first and second clamps 31 and 32 are provided on the magnet block-adjoining sides (in the upper portion of the first clamp 31 and the lower portion of the second clamp 32) with a plurality of guide grooves 31*a* and 32*a* corresponding to the cutoff abrasive blades 11 of multiple blade assembly 1. Note that the number of guide grooves 31*a* or 32*a* is not particularly limited, although eleven grooves are illustrated in the example of FIG. 4B. The guide grooves may be previously formed in the clamps before the cutoff machining of the magnet block, that is, before the magnet block is fastened by the jig. Alternatively, the magnet block is fastened by the jig having clamps without guide grooves, and when the magnet block is first machined, the first clamp 31 or second clamp 32 is machined at the same time as machining of the magnet block, to thereby define guide grooves.

During machining operation, an outer peripheral portion of each cutoff abrasive blade 11 is inserted into the corresponding guide groove 31*a* in the first clamp 31 or guide groove 32*a* of the second clamp 32. Then the grooves 31*a*, 32*a* are arranged at a spacing which corresponds to the spacing between cutoff abrasive blades 11, and the grooves 31*a*, 32*a* extend straight and parallel to each other. The spacing between guide grooves 31*a*, 32*a* is equal to or less than the thickness of magnet pieces cut from the magnet block M.

The width of each guide groove should be greater than the width of each cutoff abrasive blade (i.e., the width of the peripheral cutting part). Provided that the peripheral cutting part of the cutoff abrasive blade has a width W (mm), the guide groove should preferably have a width of more than W mm to (W+6) mm and more preferably from (W+0.1) mm to (W+6) mm. The length (in cutting direction) and height of each guide groove are selected such that the cutoff abrasive blade may be moved within the guide groove during machining of the magnet block.

In the preferred embodiment of the fastening jig, only one of the first and second clamps is provided with a resilient cantilever(s), and the other is not provided with a resilient cantilever. For example, the surface of the second clamp in contact with the magnet block is preferably flat so that the surface comes in plane contact with the entire opposing surface of the magnet block. Specifically, as shown in FIGS. 4A and 4B, only the first clamp 31 is provided with resilient cantilevers, and the surface of the second clamp 32 in contact with the magnet block M is flat so that the clamp surface comes in contact with the entire opposing surface of the magnet block M. The fastening jig of such construction is advantageous when the magnet block is machined by feeding the cutoff abrasive blades vertically from one clamp side (having resilient cantilevers) to the other clamp side, for example, from the side of first clamp 31 having resilient cantilevers to the side of second clamp 32 not having resilient cantilevers in FIGS. 4A and 4B, that is, vertically from bottom to top. When the magnet block is machined with the cutoff abrasive blades in abutment with the magnet block, the clamp disposed forward in the feed direction of the blades that force the magnet block for machining is forced more strongly. Under this situation, the plane contact of the second clamp with the entire surface of the magnet block ensures more steady support.

Notably, the clamp not having resilient cantilevers may also be provided, on its magnet block-adjoining side and at its ends corresponding to the work surfaces of the magnet block, with engagement rims for preventing the magnet block from separating away. Specifically, as shown in FIG. 4A, the portion of the second clamp 32 adjoining the magnet block M is raised at its ends corresponding to the work surfaces of the magnet block M (left and right sides in FIG. 4A) to define engagement rims 32*b*, 32*b*. The raised rims or engagement hooks 32*b*, 32*b* are effective for preventing the magnet block M from disengaging from the second clamp 32 even when the resilient cantilevers 312, 312 of the first clamp 31 are moved and spaced apart from the magnet block M (downward in FIG. 4A).

During cutoff machining, the cutoff abrasive blades are preferably rotated such that the rotational direction of the blades at the cutting point of the blades is reverse to the feed direction of the blades. Referring to the arrangement of the multiple blade assembly 1 and the magnet block M shown in FIGS. 2A to 2F, wherein the multiple blade assembly 1 is fed from bottom to top during each of cutoff machining operations on the one side and other side, the blades are rotated counterclockwise on the one side and clockwise on the other side as viewed in FIGS. 2A to 2F. That is, the rotational direction of the blades is reversed between the one side and the other side. Where the rotational direction of the blades is set in this way, cutting chips and coolant may be discharged downward, leading to easy disposal of cutting chips and coolant.

The workpiece which is intended herein to cutoff machine is a rare earth sintered magnet block. The rare earth sintered magnet (or rare earth permanent magnet) as the workpiece is not particularly limited. Suitable rare earth magnets include sintered rare earth magnets of R—Fe—B systems wherein R is at least one rare earth element inclusive of yttrium. Suitable sintered rare earth magnets of R—Fe—B systems are those magnets containing, in weight percent, 5 to 40% of R, 50 to 90% of Fe, and 0.2 to 8% of B, and optionally one or more additive elements selected from C, Al, Si, Ti, V, Cr, Mn, Co, Ni, Cu, Zn, Ga, Zr, Nb, Mo, Ag, Sn, Hf, Ta, and W, for the purpose of improving magnetic properties and corrosion resistance. The amounts of additive elements added are conventional, for example, up to 30 wt % of Co, and up to 8 wt % of other elements. Suitable sintered rare earth magnets of R—Fe—B systems may be prepared, for example, by weighing source metal materials, melting, casting into an alloy ingot, finely pulverizing the alloy into particles with an average particle size of 1 to 20 μm, i.e., sintered R—Fe—B magnet powder, forming a compact from the powder in a magnetic field, sintering the compact at 1,000 to 1,200° C. for 0.5 to 5 hours, and heat treating at 400 to 1,000° C.

EXAMPLE

Examples and Comparative Examples are given below for further illustrating the invention although the invention is not limited thereto.

Example 1

Cutoff abrasive blades (OD blades) were fabricated by providing a doughnut-shaped disk core of cemented carbide (consisting of 90 wt % WC and 10 wt % Co) having an outer diameter 115 mm, inner diameter 60 mm, and thickness 0.35 mm, and bonding, by the resin bonding technique, artificial diamond abrasive grains to the outer periphery of the core to form an abrasive section (peripheral cutting part) containing 25% by volume of diamond grains with an average particle size of 150 μm. The axial extension of the abrasive section from the core was 0.025 mm on each side, that is, the abrasive section had a width of 0.4 mm (in the thickness direction of the core).

Using the cutoff abrasive blades, a cutting test was carried out on a workpiece which was a Nd—Fe—B rare earth sintered magnet block, under the following conditions. A multiple blade assembly was manufactured by coaxially mounting 46 blades on a shaft at an axial spacing of 1.68 mm, with spacers interposed therebetween. The spacers each had an outer diameter 82 mm, inner diameter 60 mm, and thickness 1.68 mm. This setting of the multiple blade assembly was such that the magnet block was cut into magnet strips having a thickness of 1.6 mm. The multiple blade assembly was combined with a coolant feed nozzle as shown in FIG. 3, such that the outer peripheral portion of each blade was inserted into the corresponding slit in the feed nozzle.

The workpiece was a Nd—Fe—B rare earth sintered magnet block having a length 94 mm, width 45 mm and height 23 mm. By the multiple blade assembly, the magnet block was machined at 46 longitudinally equally spaced positions and divided into 47 magnet strips. With two magnet strips at opposite ends excluded, 45 magnet strips of 1.6 mm thick were recovered as effective products (rare earth sintered magnet pieces). Namely, the system was designed to produce 45 magnet strips from one magnet block.

The Nd—Fe—B rare earth sintered magnet block was secured by a fastening jig as shown in FIG. 4, prior to machining. The fastening jig included first and second clamps which were provided with guide grooves having a width of 0.6 mm (in the longitudinal direction of the magnet block), a length of 56 mm (in the transverse direction of the magnet block), and a height of 24 mm (in the thickness direction of the magnet block) in the same number (=46) as the blades and at cutoff positions of the magnet block such that the blades were aligned with the guide grooves.

Machining operation is as follows. While the fastening jig with which the magnet block was fixedly secured was held stationary, a coolant was fed at a flow rate of 60 L/min from the coolant feed nozzle. Then as shown in FIG. 2A, the multiple blade assembly 1 with the plane of rotation of its cutoff abrasive blades 11 extended vertically was placed on one side of the magnet block M (right side in FIG. 2A). The blade assembly 1 was to be fed vertically upward from this position. The cutoff abrasive blades 11 were rotated as shown in FIGS. 2A and 2B, in a direction (counterclockwise in the figure) which was opposite to the feed direction of the blade assembly 1 at the cutting point of the blades 11, and at 8,500 rpm (circumferential speed 51.2 m/sec).

Next, while the coolant was fed from the coolant feed nozzle, the multiple blade assembly 1, which was placed adjacent to the first clamp 31 of the fastening jig, was moved from the one side to the other side of the magnet block M (from right to left in FIG. 2A) so that the blades 11 were inserted into the guide grooves 31*a* over a distance of 0.5 mm from the blade periphery. The blade assembly 1 was fed vertically upward, i.e., from the bottom to the top of the magnet block M at a speed of 400 mm/min to start machining operation to form cutting grooves having a depth of 0.5 mm in the magnet block M. Once the blade assembly 1 reached the top of the magnet block M, the blade assembly 1 was moved vertically downward on the one side. The blade assembly 1, which was now placed adjacent to the first clamp 31 of the fastening jig, was moved from the one side to the other side of the magnet block M so that the blades 11 were inserted into the guide grooves 31*a* over a distance of additional 0.5 mm (i.e., 0.5+0.5 mm) from the blade periphery. The blade assembly 1 was fed vertically upward at a speed of 400 mm/min for machining operation to form cutting grooves in the magnet block M. Once the blade assembly 1 reached the top of the magnet block M, the blade assembly 1 was moved vertically downward on the one side. The machining operation was repeated until the cutting grooves reached about one-half of the thickness of the magnet block M as shown in FIG. 2C. At this point, the machining operation was once interrupted.

Then, as shown in FIG. 2D, with the magnet block M kept stationary, the multiple blade assembly 1 was moved to the other side of the magnet block M parallel to the plane of rotation of cutoff abrasive blades 11. The cutoff abrasive blades 11 were rotated as shown in FIGS. 2D and 2E, in a direction (clockwise in the figure) which was opposite to the feed direction of the multiple blade assembly 1 at the cutting point of the blades 11, and at 8,500 rpm (circumferential speed 51.2 m/sec).

Next, while the coolant was fed from the coolant feed nozzle, the multiple blade assembly 1, which was placed adjacent to the first clamp 31 of the fastening jig, was moved from the other side to the one side of the magnet block M (from left to right in FIG. 21)) so that the blades 11 were inserted into the guide grooves 31*a* over a distance of 0.5 mm from the blade periphery. The blade assembly 1 was fed vertically upward at a speed of 400 mm/min to restart machining operation to form cutting grooves having a depth of 0.5 mm in the magnet block M. Once the blade assembly 1 reached the top of the magnet block M, the blade assembly 1 was moved vertically downward on the other side. The blade assembly 1, which was now placed adjacent to the first clamp 31, was moved from the other side to the one side of the magnet block M so that the blades 11 were inserted into the guide grooves 31*a* over a distance of additional 0.5 mm (i.e., 0.5+0.5 mm) from the blade periphery. The blade assembly 1 was fed vertically upward at a speed of 400 mm/min for machining operation to form cutting grooves in the magnet block M. Once the blade assembly 1 reached the top of the magnet block M, the blade assembly 1 was moved vertically downward on the other side. The machining operation was repeated until the cutting grooves reached the remaining half of the thickness of the magnet block M as shown in FIG. 2F. At this point, the cutting grooves formed from the one and other sides merged together, whereby the magnet block M was sawn throughout its thickness, that is, divided into magnet strips.

Twelve Nd—Fe—B rare earth sintered magnet blocks were cutoff machined, and a sawing accuracy was evaluated. For each of magnet strips recovered after the division, the maximum height of a step at the merger between cutting grooves (from one and other sides) was measured on the opposite cutoff surfaces of the magnet strip. To evaluate a variation of the thickness of discrete magnet strips, the thickness between the opposite cutoff surfaces of each magnet strip was measured at five points including the center and four corners of the cutoff surface by a micrometer. A difference (A value) between maximum and minimum of thickness at 5 measurement points ranged from 3 to 46 μm, and an average of A values was calculated 15 μm. Also to evaluate a variation of the thickness of discrete magnet strips, an average (B value) of measurements of the thickness between the opposite cutoff surfaces at five points including the center and four corners of the cutoff surface ranged from 1.566 to 1.641 mm, and an average of B values was calculated 1.601 mm.

Comparative Example 1

A magnet block on one side was cutoff machined by the same procedure as in Example 1. The fastening jig was unfastened, the magnet block was released from the jig and turned upside down, and the magnet block was secured by the fastening jig again, with the cutting grooves in the magnet block being aligned with the guide grooves in the jig after the upside-down turning. The magnet block on the other side was cutoff machined by the same procedure as the one side machining in Example 1. In this way, the cutting grooves formed from the one and other sides merged together, whereby the magnet block M was sawn throughout its thickness, that is, divided into magnet strips.

Twelve Nd—Fe—B rare earth sintered magnet blocks were cutoff machined, and a sawing accuracy was evaluated as in Example 1. As a result, the A value ranged from 6 to 98 μm, the average of A values was 35 μm, the B value ranged from 1.551 to 1.633 mm, and the average of B values was 1.592 mm.

Example 2

Cutoff abrasive blades (OD blades) were fabricated by providing a doughnut-shaped disk core of cemented carbide (consisting of 90 wt % WC and 10 wt % Co) having an outer diameter 125 mm, inner diameter 60 mm, and thickness 0.35 mm, and bonding, by the resin bonding technique, artificial diamond abrasive grains to the outer periphery of the core to form an abrasive section (peripheral cutting part) containing 25% by volume of diamond grains with an average particle size of 150 μm. The axial extension of the abrasive section from the core was 0.025 mm on each side, that is, the abrasive section had a width of 0.4 mm (in the thickness direction of the core).

Using the cutoff abrasive blades, a cutting test was carried out on a workpiece which was a Nd—Fe—B rare earth sintered magnet block, under the following conditions. A multiple blade assembly was manufactured by coaxially mounting 30 blades on a shaft at an axial spacing of 1.79 mm, with spacers interposed therebetween. The spacers each had an outer diameter 93 mm, inner diameter 60 mm, and thickness 1.79 mm. This setting of the multiple blade assembly was such that the magnet block was cut into magnet strips having a thickness of 1.71 mm. The multiple blade assembly was combined with a coolant feed nozzle as shown in FIG. 3, such that the outer peripheral portion of each blade was inserted into the corresponding slit in the feed nozzle.

The workpiece was a Nd—Fe—B rare earth sintered magnet block having a length 63 mm, width 44 mm and height 21.5 mm. By the multiple blade assembly, the magnet block was machined at 30 longitudinally equally spaced positions and divided into 31 magnet strips. With two magnet strips at opposite ends excluded, 29 magnet strips of 1.71 mm thick were recovered as effective products (rare earth sintered magnet pieces). Namely, the system was designed to produce 29 magnet strips from one magnet block.

The Nd—Fe—B rare earth sintered magnet block was secured by a fastening jig as shown in FIG. 4, prior to machining. The fastening jig included first and second clamps which were provided with guide grooves having a width of 0.6 mm (in the longitudinal direction of the magnet block), a length of 56 mm (in the transverse direction of the magnet block), and a height of 22.5 mm (in the thickness direction of the magnet block) in the same number (=30) as the blades and at cutoff positions of the magnet block such that the blades were aligned with the guide grooves.

Machining operation is as follows. While the fastening jig with which the magnet block was fixedly secured was held stationary, a coolant was fed at a flow rate of 60 L/min from the coolant feed nozzle. Then as shown in FIG. 2A, the multiple blade assembly 1 with the plane of rotation of its cutoff abrasive blades 11 extended vertically was placed on one side of the magnet block M (right side in FIG. 2A). The blade assembly 1 was to be fed vertically upward from this position. The cutoff abrasive blades 11 were rotated as shown in FIGS. 2A and 2B, in a direction (counterclockwise in the figure) which was opposite to the feed direction of the blade assembly 1 at the cutting point of the blades 11, and at 8,500 rpm (circumferential speed 55.6 m/sec).

Next, while the coolant was fed from the coolant feed nozzle, the multiple blade assembly 1, which was placed adjacent to the first clamp 31 of the fastening jig, was moved from the one side to the other side of the magnet block M (from right to left in FIG. 2A) so that the blades 11 were inserted into the guide grooves 31*a* over a distance of 0.25 mm from the blade periphery. The blade assembly 1 was fed vertically upward, i.e., from the bottom to the top of the magnet block M at a speed of 1,000 mm/min to start machining operation to form cutting grooves having a depth of 0.25 mm in the magnet block M. Once the blade assembly 1 reached the top of the magnet block M, the blade assembly 1 was moved vertically downward on the one side. The blade assembly 1, which was now placed adjacent to the first clamp 31 of the fastening jig, was moved from the one side to the other side of the magnet block M so that the blades 11 were inserted into the guide grooves 31*a* over a distance of additional 0.25 mm (i.e., 0.25+0.25 mm) from the blade periphery. The blade assembly 1 was fed vertically upward, i.e., from the bottom to the top of the magnet block M at a speed of 1,000 mm/min for machining operation to form cutting grooves in the magnet block M. Once the blade assembly 1 reached the top of the magnet block M, the blade assembly 1 was moved vertically downward on the one side. The machining operation was repeated until the cutting grooves reached about one-half of the thickness of the magnet block M as shown in FIG. 2C. At this point, the machining operation was once interrupted.

Then, as shown in FIG. 2D, with the magnet block M kept stationary, the multiple blade assembly 1 was moved to the other side of the magnet block M parallel to the plane of rotation of cutoff abrasive blades 11. The cutoff abrasive blades 11 were rotated as shown in FIGS. 2D and 2E, in a direction (clockwise in the figure) which was opposite to the feed direction of the multiple blade assembly 1 at the cutting point of the blades 11, and at 8,500 rpm (circumferential speed 55.6 m/sec).

Next, while the coolant was fed from the coolant feed nozzle, the multiple blade assembly 1, which was placed adjacent to the first clamp 31, was moved from the other side to the one side of the magnet block M (from left to right in FIG. 2D) so that the blades 11 were inserted into the guide grooves 31*a* over a distance of 0.25 mm from the blade periphery. The blade assembly 1 was fed vertically upward at a speed of 1,000 mm/min to restart machining operation to form cutting grooves having a depth of 0.25 mm in the magnet block M. Once the blade assembly 1 reached the top of the magnet block M, the blade assembly 1 was moved vertically downward on the other side. The blade assembly 1, which was now placed adjacent to the first clamp 31, was moved from the other side to the one side of the magnet block M so that the blades 11 were inserted into the guide grooves 31*a* over a distance of additional 0.25 mm (i.e., 0.25+0.25 mm) from the blade periphery. The blade assembly 1 was fed vertically upward at a speed of 1,000 mm/min for machining operation to form cutting grooves in the magnet block M. Once the blade assembly 1 reached the top of the magnet block M, the blade assembly 1 was moved vertically downward on the other side. The machining operation was repeated until the cutting grooves reached the remaining half of the thickness of the magnet block M as shown in FIG. 2F. At this point, the cutting grooves formed from the one and other sides merged together, whereby the magnet block M was sawn throughout its thickness, that is, divided into magnet strips.

Five Nd—Fe—B rare earth sintered magnet blocks were cutoff machined, and a sawing accuracy was evaluated as in Example 1. As a result, the A value ranged from 1 to 25 μm, the average of A values was 8 μm, the B value ranged from 1.697 to 1.734 mm, and the average of B values was 1.717 mm.

Comparative Example 2

A magnet block on one side was cutoff machined by the same procedure as in Example 2. The fastening jig was unfastened, the magnet block was released from the jig and turned upside down, and the magnet block was secured by the fastening jig again, with the cutting grooves in the magnet block being aligned with the guide grooves in the jig after the upside-down turning. The magnet block on the other side was cutoff machined by the same procedure as the one side machining in Example 2. In this way, the cutting grooves formed from the one and other sides merged together, whereby the magnet block M was sawn throughout its thickness, that is, divided into magnet strips.

Five Nd—Fe—B rare earth sintered magnet blocks were cutoff machined, and a sawing accuracy was evaluated as in Example 1. As a result, the A value ranged from 7 to 79 μm, the average of A values was 40 μm, the B value ranged from 1.667 to 1.717 mm, and the average of B values was 1.693 mm.

Japanese Patent Application No. 2016-255022 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A fastening jig for securing a magnet block suitable for a method for multiple cutoff machining a rare earth sintered magnet block by using a multiple blade assembly comprising a plurality of cutoff abrasive blades coaxially mounted on a rotating shaft at axially spaced apart positions, rotating and feeding the cutoff abrasive blades to cutoff machine the magnet block into a multiplicity of pieces, the fastening jig comprising a first clamp on which the magnet block is rested, a second clamp disposed on the magnet block, and a press unit for pressing the first and second clamps to apply a pressing force to the magnet block from one or both of its upper and lower surfaces, wherein a portion of at least one clamp which is disposed adjacent to the magnet block is provided with a generally horizontal channel extending inward from a position corresponding to a work surface of the magnet block, to define a resilient cantilever, whereby the magnet block is held between the first and second clamps by the repulsion force created by vertical movement of the resilient cantilever.

2. The fastening jig of claim 1 wherein the portion of at least one clamp which is disposed adjacent to the magnet block is partially raised to form pads near positions corresponding to opposite work surfaces of the magnet block so that the clamp contacts only at its pads with the opposing surface of the magnet block.

3. The fastening jig of claim 1 wherein the portion of at least one clamp which is disposed adjacent to the magnet block is provided with rims at positions corresponding to opposite work surfaces of the magnet block, the rims being engaged with the magnet block for preventing the magnet block from separating apart.

4. The fastening jig of claim 1 wherein only the first clamp is provided with the resilient cantilever, and the surface of the second clamp which is disposed adjacent to the magnet block is flat so that the second clamp is in plane contact with the entire opposing surface of the magnet block.

* * * * *